US007044673B2

(12) United States Patent
Endou

(10) Patent No.: US 7,044,673 B2
(45) Date of Patent: May 16, 2006

(54) CARTRIDGE TYPE APPLICATOR

(75) Inventor: Mitsuru Endou, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 169 days.

(21) Appl. No.: 10/611,952

(22) Filed: Jul. 3, 2003

(65) Prior Publication Data

US 2004/0005185 A1 Jan. 8, 2004

(30) Foreign Application Priority Data

Jul. 3, 2002 (JP) ..... 2002-194945
Apr. 28, 2003 (JP) ..... 2003-123803

(51) Int. Cl.
*B43K 5/00* (2006.01)

(52) U.S. Cl. ..... 401/205; 401/4; 401/172; 401/174; 401/179; 401/277

(58) Field of Classification Search ..... 401/4, 401/150, 172, 174, 179, 186, 188 R, 202, 401/205, 247, 277, 288
See application file for complete search history.

(56) References Cited

U.S. PATENT DOCUMENTS 3,002,517 A * 10/1961 Pitton ..... 401/172
3,468,612 A * 9/1969 Aston ..... 401/188 R
4,348,126 A * 9/1982 Nigro ..... 401/288
4,917,522 A * 4/1990 Kay et al. ..... 401/202
4,927,282 A * 5/1990 Morane et al. ..... 401/4
5,085,352 A * 2/1992 Sasaki et al. ..... 401/174
5,383,865 A * 1/1995 Michel ..... 604/232
6,227,739 B1 * 5/2001 Kageyama ..... 401/174

FOREIGN PATENT DOCUMENTS

DE 38 26 691 A1 2/1989
DE 42 25 931 A1 2/1994
JP 2602464 7/1995

* cited by examiner

*Primary Examiner*—Tuan Nguyen
(74) *Attorney, Agent, or Firm*—Buchanan Ingersoll PC

(57) ABSTRACT

The object of the present invention is to provide a cartridge type applicator which can prevent the application liquid from flowing back from the applying portion into the cartridge and which is suitable for use with a high viscosity application liquid. This applicator includes an advancing mechanism or piston mechanism made up of a sealing plug disposed inside a cylindrical cartridge tank for constituting the rear end wall of the tank, and a rod member attached to the sealing plug for causing the sealing plug to move in the axial direction of the tank; and an actuator (actuating member) for causing the rod member to move or advance in the axial direction by rotation thereof, and is constructed such that, when the actuator is turned, the rod member causes the sealing plug to move in the axial direction so as to reduce the volume of the space inside the tank.

16 Claims, 13 Drawing Sheets

(a)

(b)

(c)

CARTRIDGE TYPE APPLICATOR

BACKGROUND OF THE INVENTION (1) Field of the Invention

The present invention relates to an applicator of a pen (brush) type for application (including writing and drawing) of ink, cosmetics such as manicure and the like and other application liquids, more detailedly relating to a cartridge type applicator having a cylindrical cartridge tank which stores application liquid and can supply the application liquid to the applying portion such as a writing tip or the like.

(2) Description of the Prior Art

As a conventional applicator, there has been a proposal of a cartridge type writing instrument shown in FIGS. 14 and 15 (see, for example, the publication of Japanese Registered Utility Model No. 2602464). This cartridge type applicator is constructed of an applicator body 70, a cartridge tank 80 and a tail plug 90.

Applicator body 70 is made of synthetic resin, having an opening at the rear end and a front barrel 71 integrally formed at the front end, with an annular projected fitting portion (projected engaging portion) 72 formed near the rear end on the inner periphery so as to be perpendicular to the axis. Front barrel 71 is formed with a brush 71*a* projected forwards. A pipe 73 for supplying the liquid to this brush element 71*a* is fixed to front barrel 71 and is arranged so as to project rearwards in the front part inside applicator body 70. Designated at 74 is a cap fitted on applicator body 70.

A cartridge tank 80 holds an application liquid inside a tank body 81. A valve element 82 is attached to an opening at the front end of tank body 81 while an inner front barrel 83 of synthetic resin is fitted on the outer periphery at the front end of tank body 81 so as to cover the valve element 82. A stepped portion 84 facing to the rear is formed on the outer periphery of tank body 81.

A tail plug 90 is a hollow cylinder formed of synthetic resin having open ends. A cutout portion 91 is formed in its side at the rear end. A stepped portion 92, against slippage when the tail plug is fitted, is formed in the side at the rear end. An anti-rolling projection 93 is formed on the outer periphery. Tail plug 90 further has a depressed fitting portion (depressed engaging portion) 95 on the front outer periphery, having slits 94, 94, . . . , parallel to the axis, and mating the aforementioned projected fitting portion 72 of applicator body 70 in a detachable manner with an appropriate interface. A joint portion 96 which is reduced in outside diameter is formed at the rear of the depressed fitting portion so as to be fitted into applicator body 70.

Assembly of the thus constructed applicator body 70, cartridge tank 80 and tail plug 90 is started with tail plug 90 being fitted from the rear end side of cartridge tank 80. In this case, the front opening edge, designated at 97, of tail plug 90 abuts stepped portion 84 of cartridge tank 80, so that fitting of tail plug 90 stops. The tail plug 90 thus fitted is inserted into applicator body 70 from its rear end opening. Thereby, depressed fitting portion 95 of tail plug 90 is fitted and fixed to projected fitting portion 72 of applicator body 70 as the outer peripheral part, having slits 94, contracts narrowing the slits 94 within limit, while pipe 73 of applicator body 70 is inserted into the opening of inner front barrel 83 of cartridge tank 80. Thus, the assembly is completed.

With this conventional applicator 70 thus configured, the pressure in cartridge 80 decreases due to repeated liquid discharge, hence the liquid at the applying portion is drawn back into the cartridge, causing application failure. In some cases, the applicator may become unusable for sanitary reasons. Further, this kind of cartridge type applicator has a usable viscosity limit with respect to the application liquid, suffering problems with high viscosity liquids, through no problems occur with low viscosity liquids.

SUMMARY OF THE INVENTION

The present invention has been devised in order to solve the above problems, it is therefore an object of the present invention to provide a cartridge type applicator which can prevent the application liquid from flowing back from the applying portion into the cartridge and which is suitable for use with a high viscosity application liquid.

The inventors hereof have found that gradual reduction of the volume of the space in the cartridge by means of an advancing mechanism or piston mechanism which is provided at the rear end of a cylindrical tank, i.e., the cartridge body, enables the application liquid to be smoothly supplied to the applying portion without causing any return of the application liquid which was once supplied to the applying portion, and enables beneficial transfer of the application liquid to the applying portion and stable application without causing the above deficiencies even when a high viscosity application liquid is used and herein have reached the present invention.

Specifically, the applicators according to the present invention are characterized by the following configurations or mechanisms, in order to solve the above problems.

A cartridge type applicator according to the present invention includes a hollow barrel body being molded in predetermined design and an applying portion provided so that part thereof is projected from the front end of the barrel body. In general, the cartridge tank for storing an application liquid is inserted or pulled out from the rear end of the barrel body, and when it is attached, the applying portion is refilled or supplied with the application liquid from the front opening of the tank. Usually, the cylindrical cartridge tank has a removable sealing element which seals off the front opening of the cartridge tank and a socket for the sealing element, disposed at the front end part, and the sealing element, more specifically, a seal ball, is displaced from the socket when the cartridge is fitted. Since the cartridge is sold individually from the applicator body, the front end of the cartridge is covered with a protecting cap or the like.

The cartridge type applicator according to the present invention includes an advancing mechanism or piston mechanism made up of a sealing plug disposed inside the cylindrical cartridge tank for constituting the rear end wall of the tank, and a rod member attached to the sealing plug for causing the sealing plug to move in the axial direction of the tank; and an actuator (actuating member) for causing the rod member to move or advance in the axial direction by rotation thereof, and is characterized in that, when the actuator is turned, the rod member causes the sealing plug to move in the axial direction so as to reduce the volume of the space inside the tank.

In the cartridge type applicator according to the present invention, the actuator and the tail plug of the applicator may be integrally formed, or the actuator and the tail plug may be formed separately. Further, the actuator may be constructed of a number of smaller parts.

In the case where the actuator and the tail plug are formed separately, it is preferred that the tail plug covers part of the actuator and is rotatably and removably attached at the rear end part of the barrel body but is arranged so as to be unable to rotate with respect to the actuator. This makes it possible to cause the sealing plug to move in the axial direction through the rod member when the actuator is turned by rotation of the tail plug.

In the above way, in the configuration where the tail plug and the actuator are provided separately, the cartridge tank with an advancing mechanism or piston mechanism can be integrally assembled in the manufacturing process. Further, for cartridge replacement, the tail plug may be fitted to the cartridge tank with an advancing mechanism first and then the whole part can be simply fitted to the barrel body.

In the cartridge type applicator according to the present invention, in the case where the tail plug and the actuator are provided so as to be unable to mutually rotate as stated above, it is preferred that an engaging portion is formed in the inner wall of the tail plug in the axial direction while an engaging portion is formed in part of the outer wall of the actuator, so that the tail plug and the actuator engage each other with their engaging portions.

The engaging portions here indicate axial or annular linear projections (ribs etc.) and linear recesses and form engagement by these linear engaging portions (including engagement between ribs only and engagement between linear projections and linear recesses). Accordingly, when these engaging portions of the tail plug and actuator are formed in the axial direction, it is possible that the engagement easily prohibits the tail plug and actuator from turning relative to the other. Further, when the engaging portions are formed circumferentially, the engagement provides restraint of these parts with respect to the axial direction, as will be described later. These engaging portions are preferably formed at multiple sites in each wall.

In the cartridge type applicator according to the present invention, an engaging portion is formed circumferentially in the outer or inner wall of the tail plug while an engaging portion is formed circumferentially in the inner or outer wall of the barrel body, so that the tail plug and the barrel body can be removably press fitted to each other at their engaging portions and can be held so as to rotate relative to the other. In this engagement structure, it is preferred that the tail plug is formed with a slit allowing for easy press fitting and easy removal and formed in the axial direction. The engaging portions mentioned here indicate the aforementioned linear projections and recesses formed circumferentially. The tail plug may be either fitted into or over the rear end part of the barrel body.

When one or more axial slits are formed in the tail plug, the engagement surface (or the fitting surface if with the linear projection and recess) of the tail plug may easily deform, varying its diameter by virtue of the slits, so that the tail plug can be readily fitted to, or pulled out from, the barrel body.

In the cartridge type applicator according to the present invention, usually, a removable sealing element such as a seal ball for closing the opening at the front end of the tank is provided while a socket for the sealing element is formed in the inner wall of the front end portion.

The socket of the sealing element may be integrally formed with the front end part of the tank. Preferably a substantially pipe-like socket is separately formed at the front end portion, the socket being formed of a thermoplastic resin molding.

The present invention is also characterized in that the inner wall of the socket is formed in a turnup wall configuration in which a clearance is formed around the inner wall.

The cartridge tank is usually formed of plastic, in a cylindrical or cap-like form, by injection molding, blow molding or the like. Use of thermoplastic resin enables easy formation of a socket, in the inner wall of the tank, which is suitable for a sealing element, e.g., a ball-like sealing element. In particular, since the tank in the present invention needs to be formed in a cylindrical form because of provision of an advancing mechanism, the socket can be easily formed in a turnup wall configuration with a clearance formed around the inner wall of the tank, and produces the following merits.

That is, formation of a clearance around the inner wall that constitutes the socket, makes it possible for the inner wall to easily break away toward the surrounding clearance when the sealing element is press fitted or when pulled out. Therefore, it is possible to easily disperse the pressing force applied when the sealing element is press fitted or pulled out. As a result, the applied force when the sealing element is pressed in the manufacturing process can be set as appropriate while a sufficient sealability can be obtained. Hence, the sealing element can be easily sunk in (displaced) at the start of usage.

With concern to the above, it is preferred that the surface of the sealing element in contact with the inner wall of the socket is of a curved surface. Illustratively, if the sealing element is spherical, elliptical or in a similar form, the sealing element can be smoothly press fitted or pushed out.

It should be noted that either the sealing element after its displacement may be used as an agitating element of the application liquid in the tank, or a separate agitator may be used.

In the cartridge type applicator according to the present invention, it is preferred that an engaging portion such as a linear projection and linear recess is formed in the cartridge tank along the axial direction as stated above while an engaging portion to be engaged with the tank's engaging portion is formed along the axial direction in the inner wall of the barrel body.

Usually, when the cartridge tank is inserted, the tank is squeezed into the barrel body so as to steady the fixture by the force derived from elastic deformation of the barrel body or other elements. However, this will not assure rotational inability between the cartridge tank and the barrel body. Such unreliability in prohibiting rotation may cause skidding of the actuator in the advancing mechanism when it is rotated. Therefore, it is preferred that the tank is steadily fixed in the barrel body so as not to rotate thereto by the axial engagement between the linear engaging portions in the tank and the barrel body, as stated above.

In the cartridge type applicator according to the present invention, a removable cap for covering the applying portion is provided. In this case, it is preferred that the cap incorporates an inner cap element which is pressed toward the applying portion by means of an elastic element when the cap is fitted, the inner cap element has a mouth which can come into sealing contact with the outer peripheral wall face of the applying portion, with a predetermined pressure.

In the above way, since the mouth of the inner cap element is fitted on the outer peripheral wall face of the applying portion under a substantially uniform pressing force obtained from the elastic element, repeated actions of fitting and removal of the cap never causes an excess pressure to act between the mouth and the outer peripheral wall face or conversely that sealing performance degrades due to loose abutment. Since the repulsive force of the elastic member is substantially uniform and weak, like that of a small spring, the pressure arising in the narrow inner space between the inner cap element and the applying portion is low. Therefore, it is possible to maintain a good pressure state in combination with maintenance of the pressure state of the storage tank.

In the present invention, the inner cap element may be attached to the cap by means of a predetermined length of an elastic element. It is preferred that the inner cap element is held within the cap when the applying portion is removed.

Further, when the cap is removed, there is a risk that the press fittings between the mouth and the outer peripheral wall will not readily depart from each other and hence the inner cap element might pull the elastic element and stretch the elastic element. Therefore, it is preferred that a stopper projection for restraining the inner cap element is formed on the inner wall surface etc., of the cap.

Here, the elastic element should not be particularly limited as long as it can provide such elasticity or flexibility similar to that of a spring, rubber or the like. Particularly, a coil spring is preferably used in the present invention.

DESCRIPTION OF THE PREFERRED EMBODIMENTS

Figure 1A:
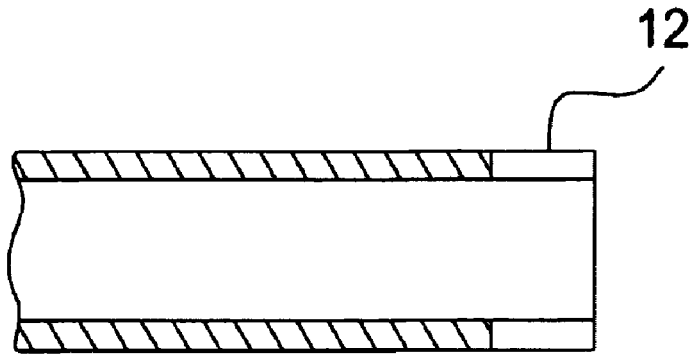
FIG. 1*a* is a sectional view of an embodiment of a barrel body.

The preferred embodiments of cartridge type applicators of the present invention will hereinbelow be detailed with reference to the accompanying drawings. It should be noted that the applicator according to the present invention is not limited to the following embodiments.

One embodiment of an applicator of the present invention is a cartridge type writing instrument 1 shown in FIG. 1. Writing instrument 1 is mainly composed of an approximately cylindrical barrel 2, a front barrel 3 having a writing part (applying portion) 4 arranged at the front end of barrel 2, a cartridge tank 5 detachably inserted into barrel 2, and a tail plug 6.

Figure 1B:
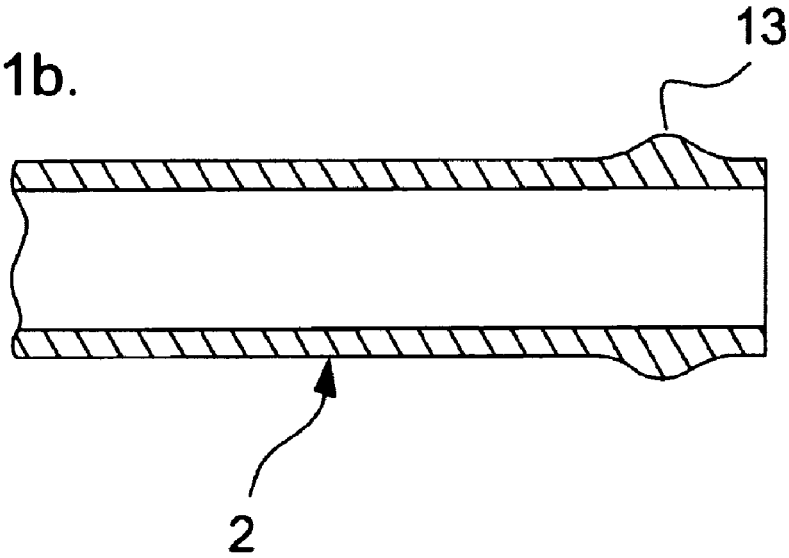
FIG. 1*b* is a sectional view of an embodiment of a barrel body.
Figure 1C:
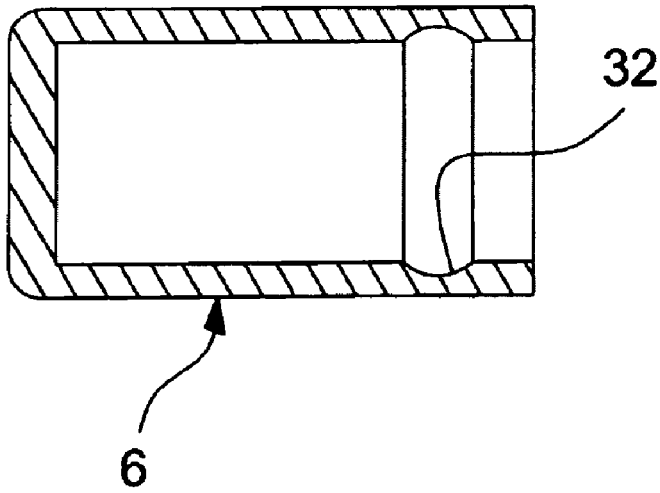
FIG. 1*c* is a sectional view of an embodiment of an end plug.
Figure 2:
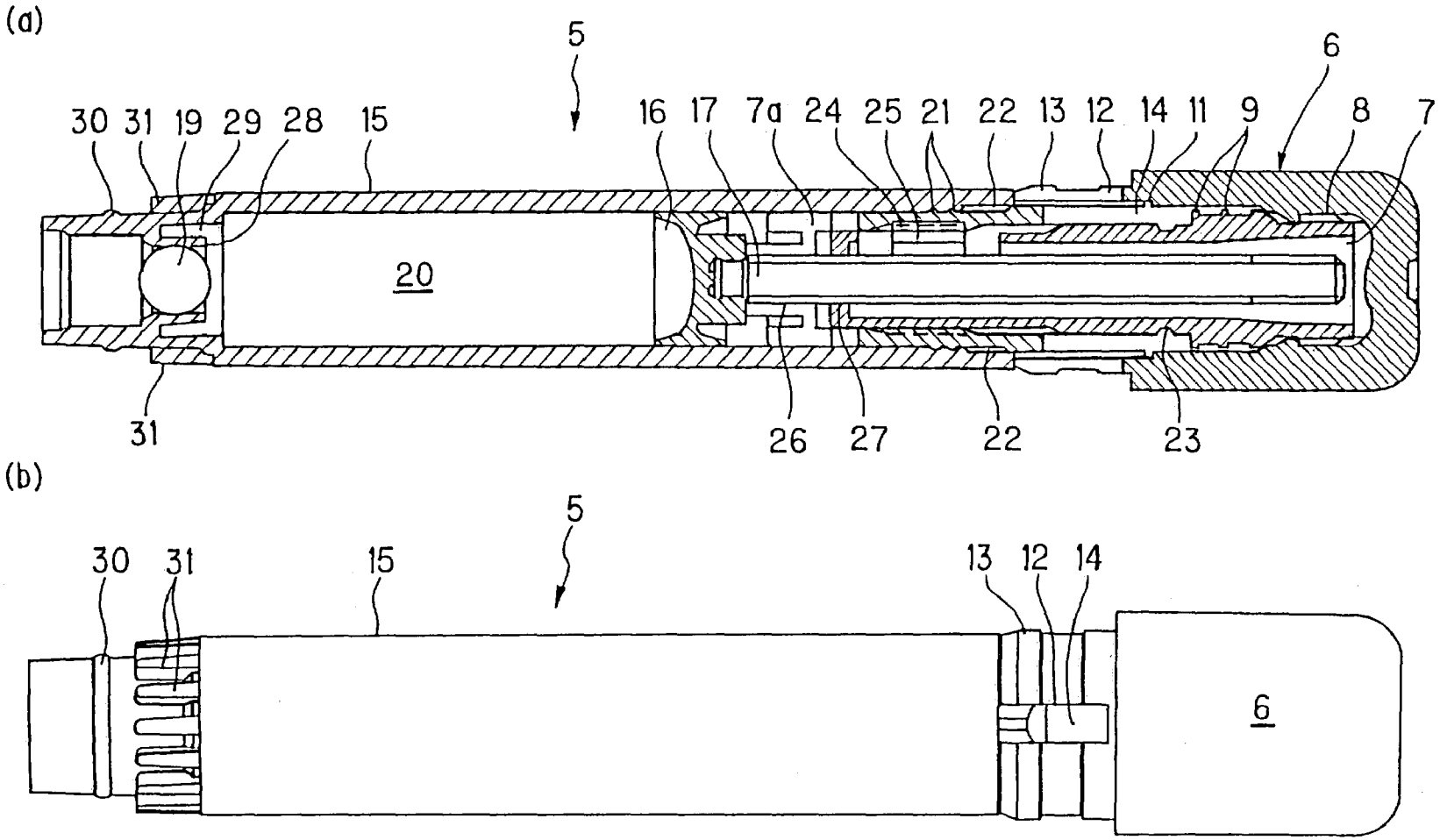
FIGS. 2(*a*) and 2(*b*) are side and side sectional views showing a tail plug-combined cartridge tank in the embodiment.
Figure 3:
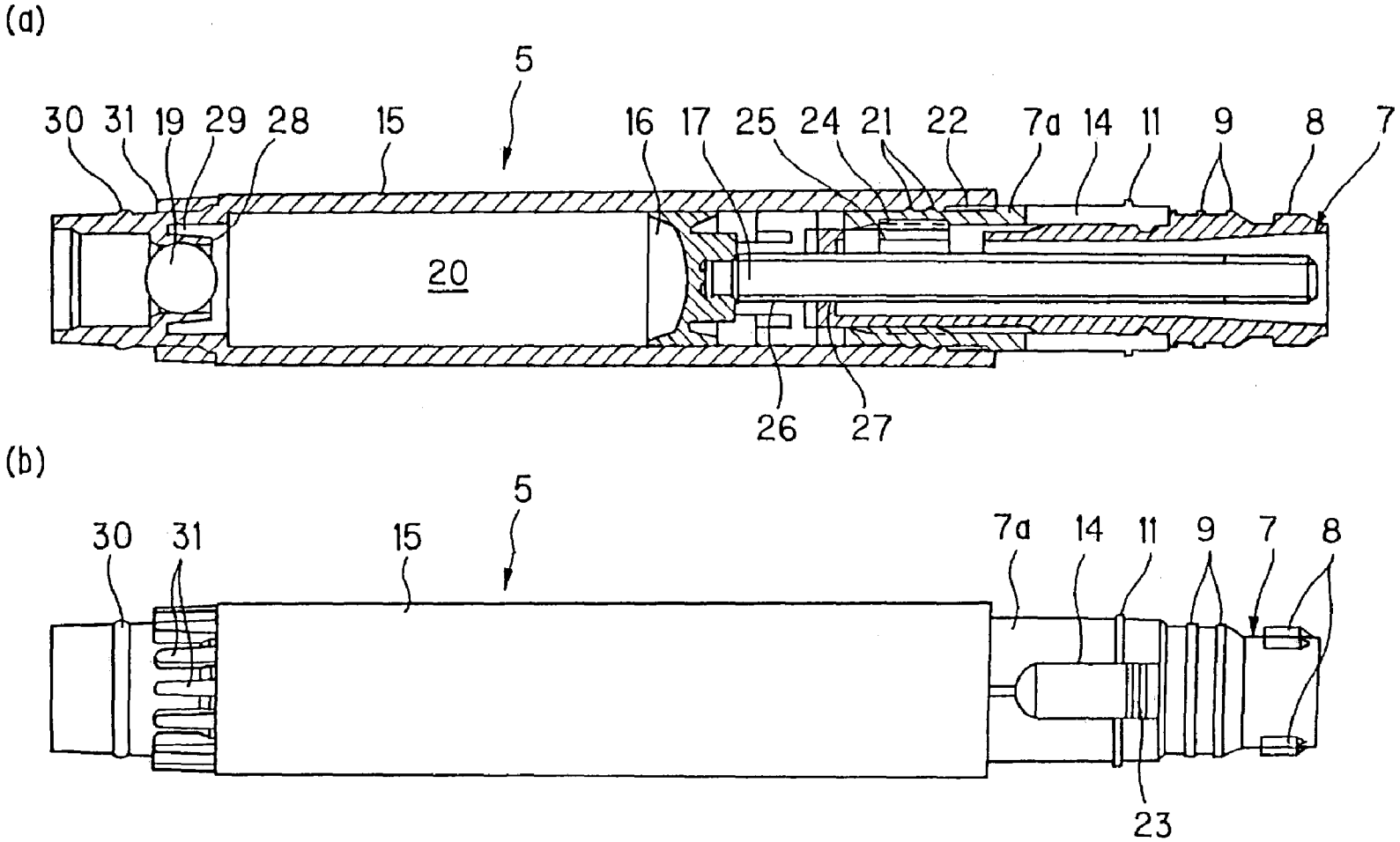
FIGS. 3(*a*) and 3(*b*) are side and side sectional views showing a cartridge tank in the embodiment.

Cartridge tank 5 shown in FIGS. 1 to 3 is inserted in and fitted to barrel 2 and removed therefrom. This means that the cartridge tank is replaceable with respect to writing instrument 1. Therefore, cartridge tank 5 is covered with an unillustrated protecting cap or the like, and sold separately on the market.

Figure 4:
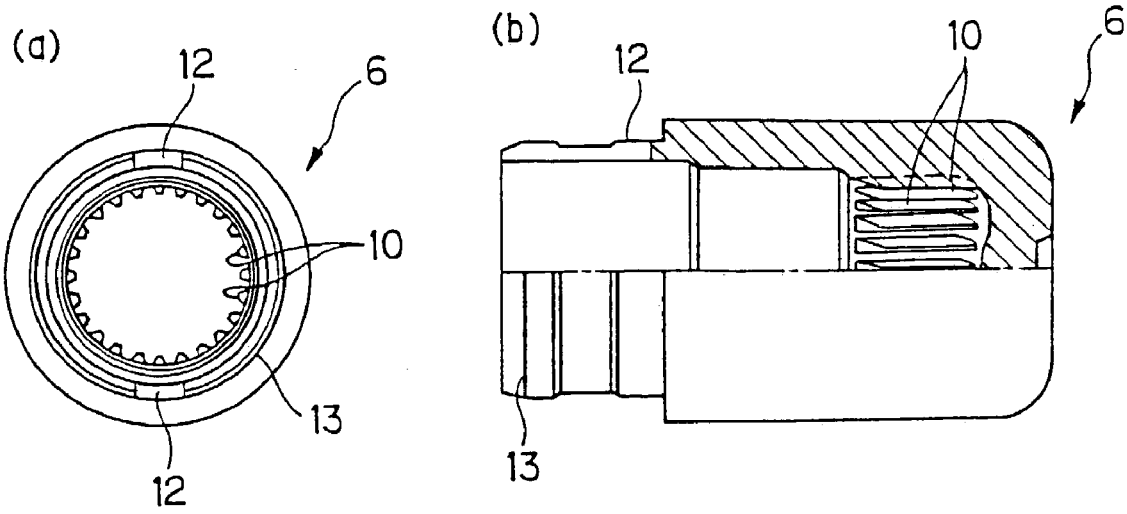
FIGS. 4(*a*) and 4(*b*) are front and side sectional views showing a tail plug in the embodiment.

As shown in FIG. 2, a tail plug 6 is configured in a cap-like form to cover the rear end of an advancing element (actuator) 7. As shown in FIG. 3, a multiple number of linear projections (or ribs.) 8 extending in the axial direction and two linear projections 9 extending circumferentially are formed in the rear end part of advancing element 7. Formed along the axial direction in the inner wall of tail plug 6 are a multiple number of linear projections 10 as shown in FIG. 4. Therefore, when the rear end part of advancing element 7 is covered with tail plug 6, linear projections 8 and linear projections 10 are engaged one with the other, so that tail plug 6 and advancing element 7 are fitted in a mutually unrotatable manner. Further, an aftermentioned auxiliary pipe 7*a* as an auxiliary element is fitted on advancing element 7 so that they can be rotated in their respective one-way directions. Further, tail plug 6 and advancing element 7 are joined together when manufactured, so as not to play and not to be easily part with each other, by means of an annular projection 11 formed on auxiliary pipe 7*a* and the aforementioned two annular linear projections 9 on advancing element 7.

Two slits 12 are formed in the opening portion of tail plug 6. A linear projection 13 is formed circumferentially on the outer wall surface of tail plug 6 where slits 12 are located. This linear projection will be engaged with an aftermentioned linear recess 32 formed on the inner wall in the rear end part of barrel 2. Accordingly, as the front end of tail plug 6 is squeezed into the rear end of barrel 2, slits 12 briefly contract so that the tail plug 6 varies in diameter, whereby insertion or removal of tail plug 6 becomes easy. It should be noted that auxiliary pipe 7*a* is also formed with slits 14 so that it can be easily engaged with a linear engaging portion 23 and hence easily fitted on advancing element 7.

FIG. 1*a* is a sectional view of an alternate embodiment that includes a slit 12 formed in the barrel body 2 in the axial direction and allowing for easy press fit and easy removal of the end plug 6. FIG. 1*b* is a sectional view of an alternate embodiment that includes a linear projection 13 formed on the outside of the barrel body 2. FIG. 1*c* is a sectional view of an alternate embodiment that includes the end plug 6 for fitting over the outside of the barrel body 2. The end plug 6 has a linear recess 32 formed circumferentially on its inside. It should be recognized that the linear recess 32 and the linear projection 13 can alternately be formed on the barrel body 2 and the end plug 6 respectively, and that the linear recess 32 and the linear projection 13 can be alternated with one another.

As shown in FIGS. 2 and 3, cartridge tank 5 includes a cylindrical tank body 15, a piston mechanism comprised of the aforementioned advancing element 7, a sealing plug 16 and a threaded rod 17, and a seal ball 19. The space in tank body 15, enclosed by seal ball 19 and sealing plug 16 constitutes an application liquid storage chamber 20.

The front part of advancing element 7 is inserted into the rear part of tank body 15 and held by body 15 by means of the aforementioned auxiliary pipe 7*a*. More specifically, multiple linear projections 21 are formed circumferentially on the outer wall surface of auxiliary pipe 7*a* and fitted to the linear recesses formed on the inner wall surface of tank body 15. Further, ribs 22 are formed in the axial direction on the inner wall surface of tank body 15 so as to limit rotation of auxiliary pipe 7*a* with respect to body 15.

Advancing element 7 is arranged so as to be able to turn relative to auxiliary pipe 7*a*, owing to provision of engaging rib 23. A multiple number of ribs 24 are formed in the axial direction on the inner wall surface of auxiliary pipe 7*a* while a projected portion 25 having resiliency is formed on the outer wall surface of the cylindrical part of advancing element 7, whereby advancing element 7 is allowed to turn in a one-way direction only relative to auxiliary pipe 7*a* and is restricted from turning in the opposite direction, by means of engagement between ribs 24 and projected portion 25.

The inner wall surface of the front end part of auxiliary pipe 7*a* is formed with a female threaded portion 26 which mates threaded rod 17. Advancing element 7 is assembled so that its front end 27 rotates together with threaded rod 17 and so that threaded rod 17 can move in the axial direction. Therefore, when advancing element 7 or tail plug 6 is rotated, threaded rod 17 advances in the axial direction. Sealing plug 16 is disposed at the front end of threaded rod 17 so that it can rotate relative to threaded rod 17. Sealing plug 16 plugs up the interior of body 15 and creates fluid-tight contact between its outer peripheral side and the inner wall of body 15.

The front part of tank body 15 is stepped and formed with a reduced diameter by the wall thickness of an unillustrated cap, so that the cap is removably fitted thereon when the product is sold. Formed with the inner wall at the front part of tank body 15 is a ball socket 28 of a seal ball 19 as a sealing element. Ball socket 28 is formed in a turnup wall configuration in which a clearance 29 is formed around the inner wall on which the ball 19 abuts. This can be integrally formed when tank body 15 is molded. Seal ball 19 is squeezed into socket 28 and fitted therein so that it can be displaced from socket 28 and creates fluid-tight contact with the abutment wall. As a result, the spaced enclosed by the inner wall of tank body 15, sealing plug 16 and seal ball 19 is formed as storage chamber 20 for application liquid, i.e., ink.

A linear projection 30 is formed circumferentially on the outer wall surface in the front part of tank body 15. This projection 30 is engaged with a linear recess formed in the inner wall near the front end of barrel 2 when the tank is fitted to barrel 2 of writing instrument 1. A multiple number of ribs 31 are formed from the front edge of the step of tank body 15. Ribs 34 formed in the axial direction on the inner wall surface in the front end part of barrel 2 are inserted between the ribs 31 when the tank is fitted to barrel 2 of writing instrument 1. Therefore, when cartridge tank 5 is attached, it can be held so as not to be rotatable inside barrel 2 and so that it will not be easily pulled out in the axial direction.

Figure 5:
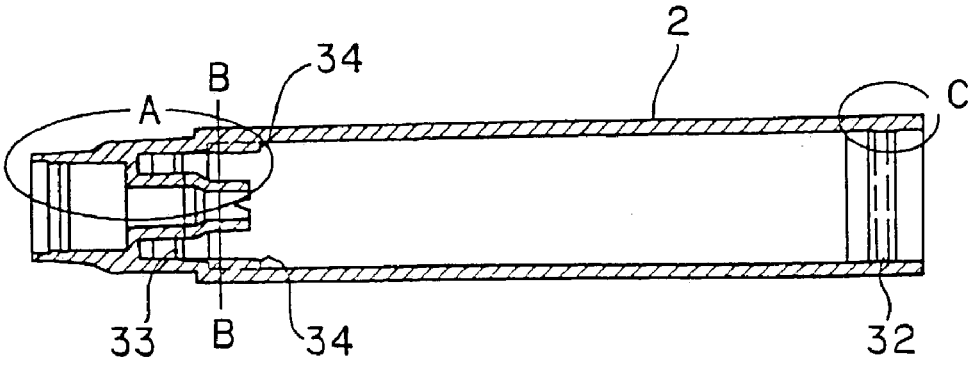
FIG. 5 is a side sectional view showing a barrel in the embodiment.
Figure 6:
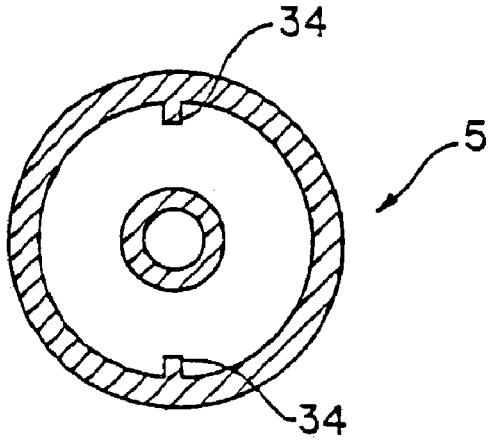
FIGS. 6(*a*) to 6(*c*) are an enlarged view of the A portion of the barrel shown in FIG. 5, an enlarged sectional view cut along a plane B—B and an enlarged sectional view of the C portion.
Figure 6:
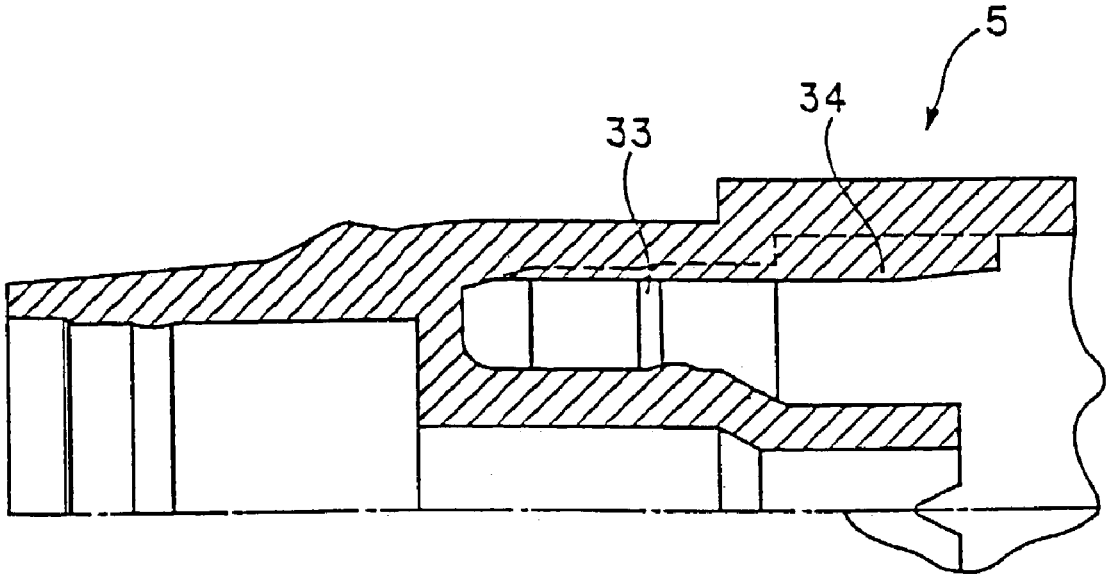
Figure 6:
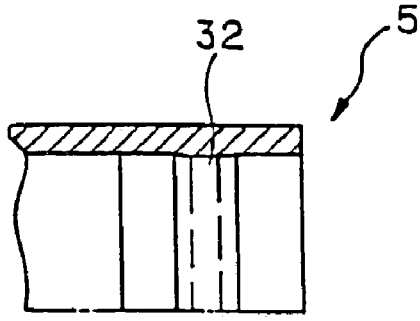
Figure 7:
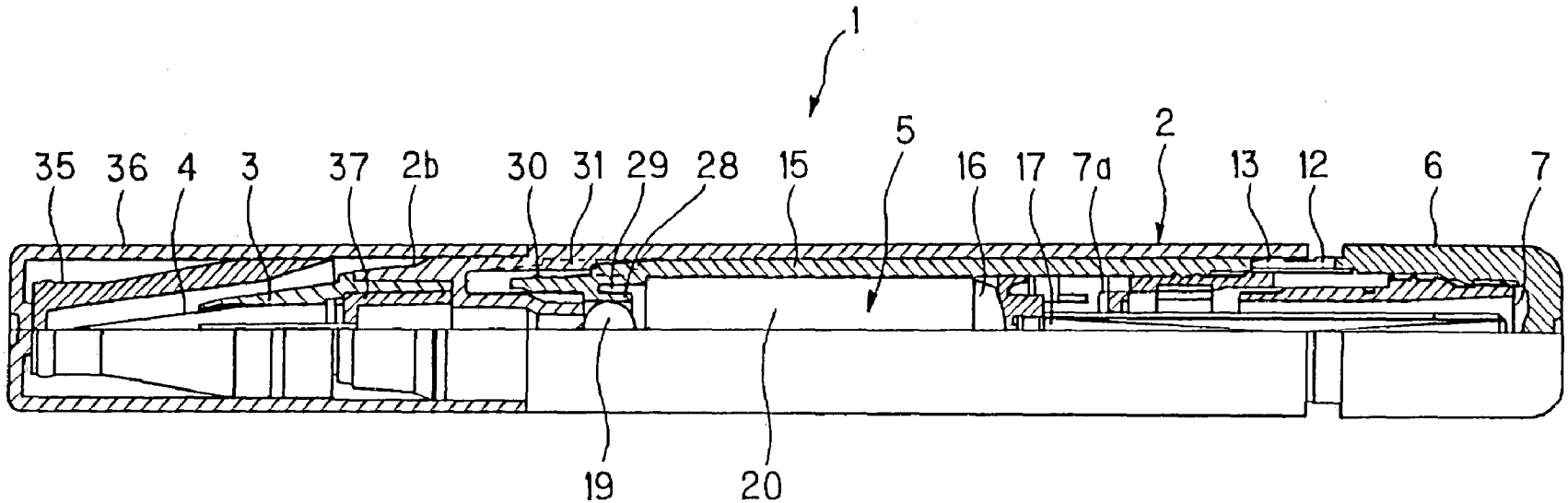
FIG. 7 is a partially sectional side view showing the state just before attachment of a cartridge tank combined with a tail plug to the cartridge type applicator of the embodiment.

As shown in FIGS. 5 and 6, linear recess 32 to be engaged with the aforementioned linear projection 13 formed circumferentially in the outer wall surface of tail plug 6 is formed circumferentially on the inner wall surface in the rear end of barrel 2. Further, a linear recess 33 to be engaged with projection 30 formed circumferentially on the outer wall surface in the front end of tank body 15 as well as ribs 34 to be fitted between ribs 31 in the front part of tank body 15 are provided in the inner wall in the front end part of barrel 2.

Arranged at the front end, designated at 2*b*, of barrel 2 is front barrel 3, which is covered by an inner cap 35 and outer cap 36. Front barrel 3 is formed with a writing part 4 and a joint pipe 37. The proximal end of writing part 4 is attached to the front end of joint pipe 37. Joined section between writing part 4 and joint pipe 37 is covered by front barrel 3 so as to protect part of writing part 4 and the joined section.

Upon assembly of the thus constructed writing instrument 1, an unillustrated cap at the front end or cap at the rear end is removed from cartridge tank 5 as shown in FIG. 3, and tail plug 6 is squeezed into rear end and fixed thereto, as shown in FIG. 2. In this case, linear projection 13 of tail plug 6, as it is radially deformed, is fitted to barrel 2 so that-tail plug 6 is fixed correctly. Linear projections 8 formed axially on tail plug 6 and linear projections 10 on advancing element 7 are engaged with each other so that tail plug 6 and advancing element 7 are fixed so as to be mutually unrotatable.

This cartridge tank 5 with tail plug 6 assembled thereto is inserted from the rear end of barrel 2. Before insertion, seal ball 19 of cartridge tank 5 has not yet come off from socket 28 and abuts the inward opening in the front part of barrel 2.

In this case, since socket 28 is formed as a turnup wall which defines clearance 29 around the inner wall, the thickness of the inner wall, which positions seal ball 19, can be made small or can be easily controlled. Therefore, the pressing force of seal ball 19 onto the inner wall for placement or displacement can be relieved to clearance 29 located outside. As a result, seal ball 19 can be squeezed into socket 28 with an appropriate pressing force while seal ball 19 can be easily pushed in from socket 28 when the cartridge tank is fitted.

A further insertion of tail plug 6 sinks seal ball 19 into storage chamber 20, as shown in FIG. 1. Linear projection 13 on the outer wall surface of tail plug 6 fits linear recess 32 in the inner wall surface of barrel 2 so that tail plug 6 can be held rotatably. In this case, tail plug 6 is squeezed in, but can be smoothly fitted into barrel 2, owing to the deformation at slits 12. Further, linear projection 30 in the front part of tank body 15 is fitted into linear recess 33 formed in the inner wall surface of barrel 2 while ribs 34 on barrel 2 become engaged between ribs 31, so that tank body 15 is held so as to be unrotatable relative to barrel 2.

Figure 8:
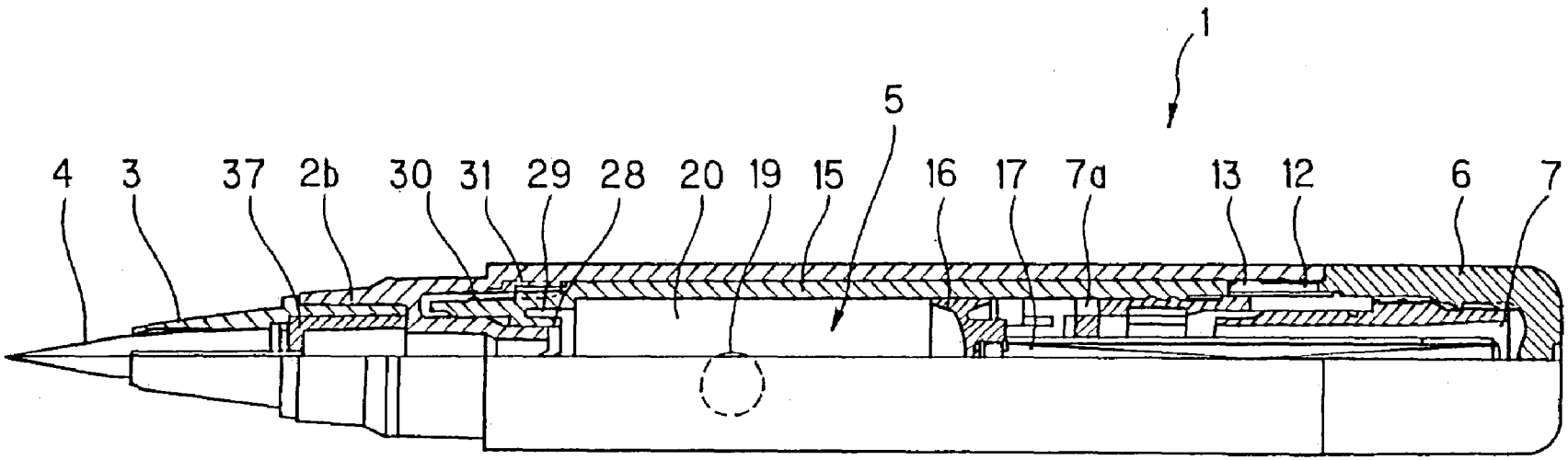
FIG. 8 is a partially sectional side view showing the state of using a cartridge type applicator of the embodiment.

Writing instrument 1 thus conditioned may be used with its cap removed, as shown in FIG. 8. With the progress of use, ink in storage chamber 20 of cartridge tank 5 decreases. In some cases, a pressure reduction in the storage chamber 20 may take place, and there is a risk of ink flowing back from writing part 4 into storage chamber 20. In this case, turning the tail plug 6 causes advancing element 7 to rotate, hence threaded rod 17 is advanced by the engagement between threaded rod 17 and female threaded portion 26. Advancement of threaded rod 17 causes movement of sealing plug 16, thus making it possible to gradually reduce the volume of storage chamber 20.

With this arrangement, any ink, which once has been supplied to writing part 4, will never return. Further, ink will not be pulled back but can be smoothly delivered to writing part 4. This configuration also secures stable drawing even with use of a high-viscosity ink.

Figure 9:
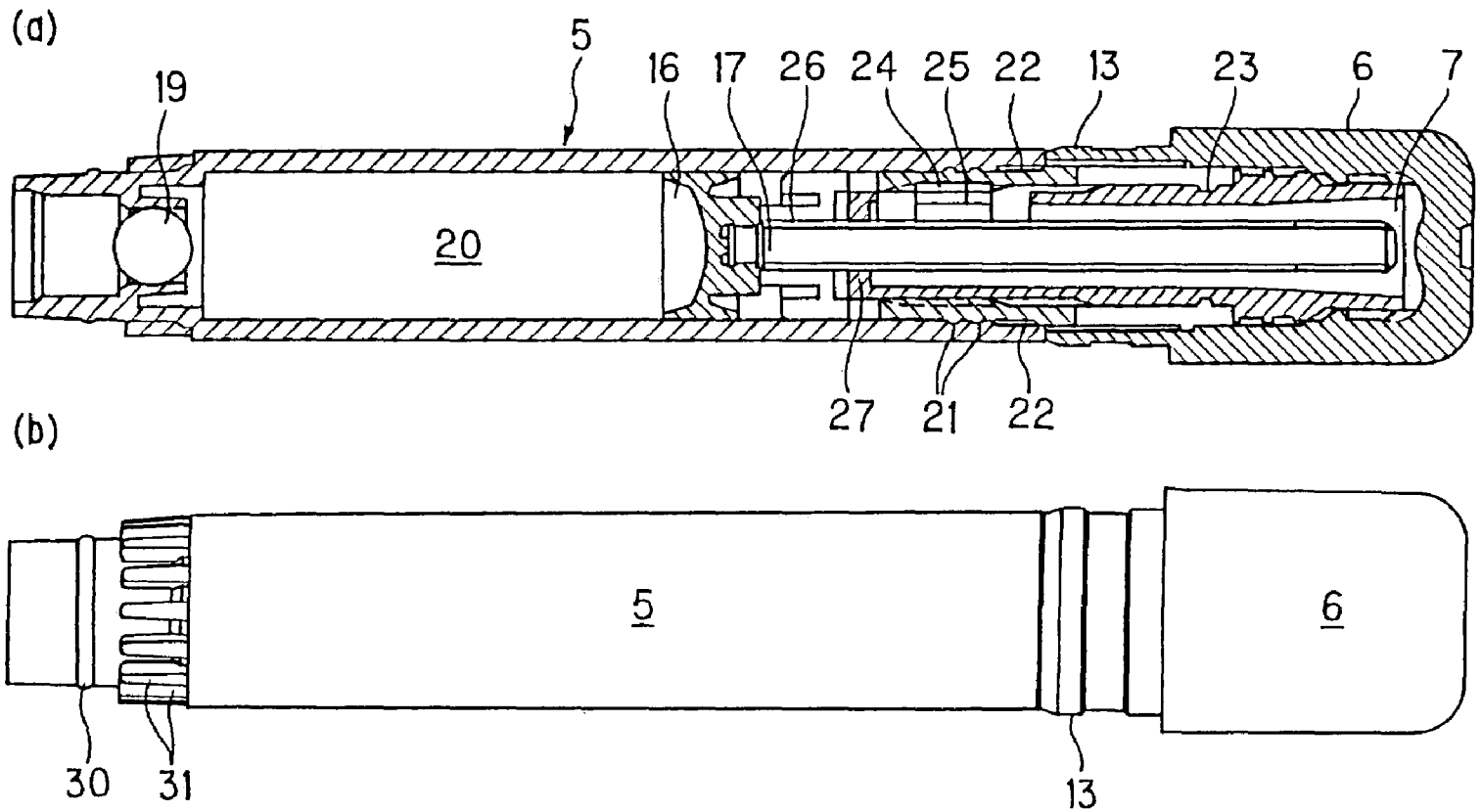
FIGS. 9(*a*) and 9(*b*) are side and side sectional views showing a partly modified variational embodiment of a tail plug-combined cartridge tank.

In this embodiment, provision of slits for tail plug 6 is not essential, but the same effect can be fully achieved by a configuration without any slits, as shown in FIG. 9.

Figure 10:
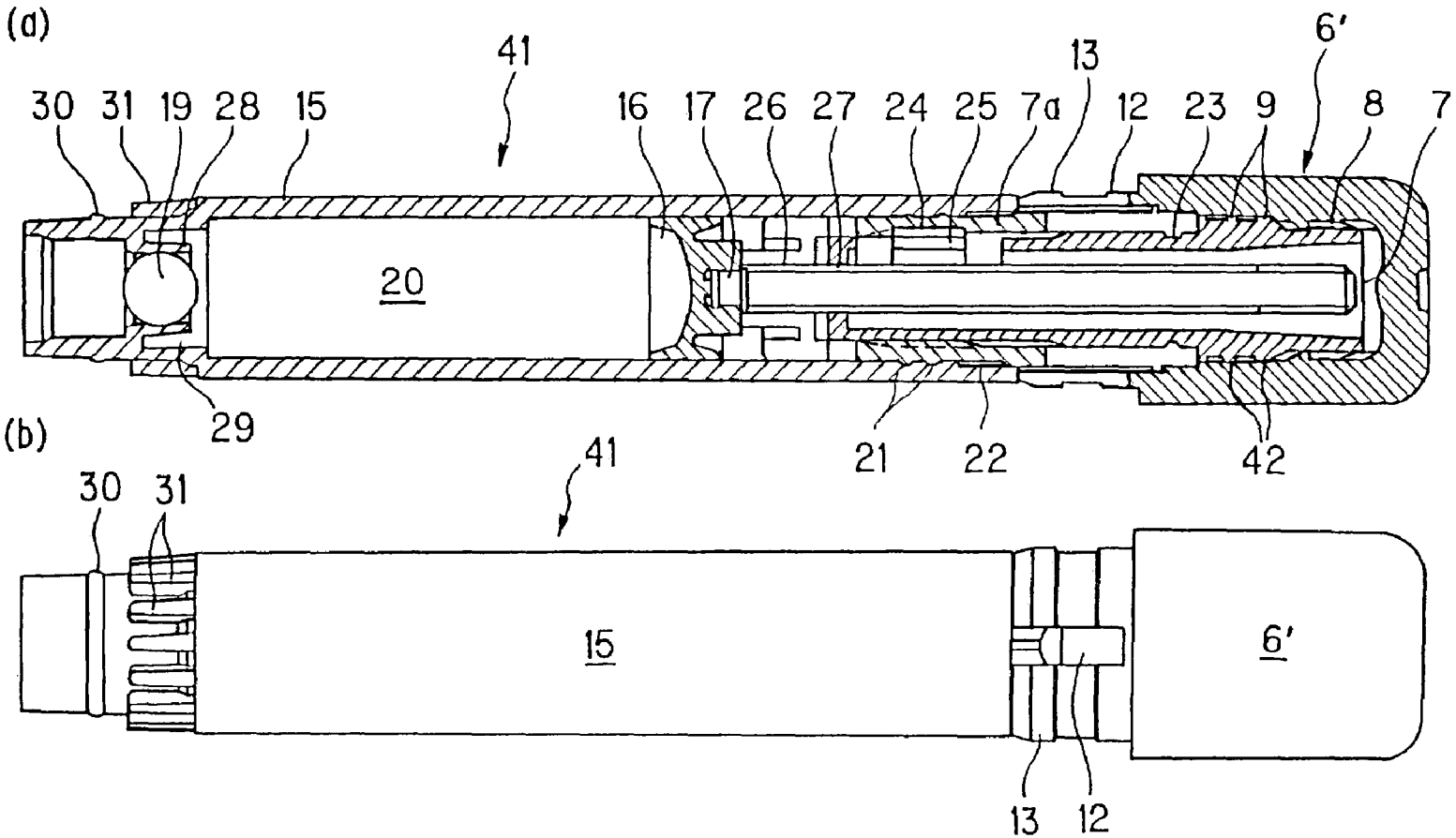
FIGS. 10(*a*) and 10(*b*) are side and side sectional views showing a partly modified variational embodiment of a tail plug-combined cartridge tank.

FIGS. 10(*a*) and 10(*b*) are side and side sectional views showing another embodiment of a tail plug-combined cartridge tank. A tail plug-combined cartridge tank 41 shown in FIG. 10 has almost the same structure as the tail plug-combined cartridge tank shown in FIG. 2, and is made up of the same or similar components. Therefore, the similar structure and components are allotted with the same reference numerals as in FIG. 2, without detailed description.

In a tail plug-combined cartridge tank 41 shown in FIG. 10, a linear recess 42 is formed circumferentially in the inner wall surface of the tail plug, designated at 6'. This linear recess 42 is adapted to fit with linear projection 9 formed circumferentially on the outer wall surface of advancing element 7 when the cartridge tank and tail plug 6' is assembled. Therefore, the cartridge and the tail plug can be correctly held by each other, differing from the press-fitting relationship between the cartridge tank and tail plug shown in FIG. 2.

Figure 11:
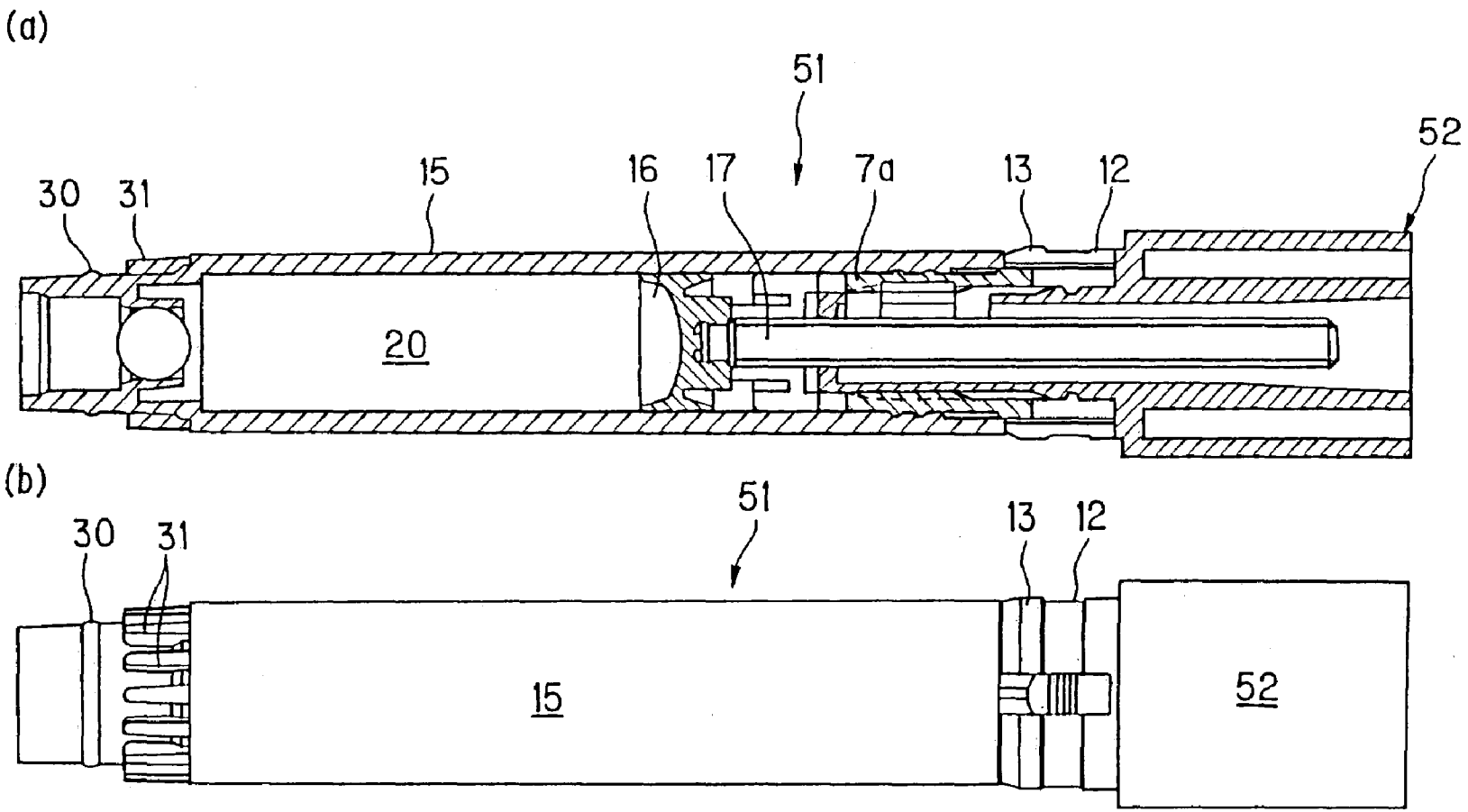
FIGS. 11(*a*) and 11(*b*) are side and side sectional views showing a tail plug-combined cartridge tank in another embodiment of a cartridge type applicator of the present invention, in which an actuator also serves as a tail plug.

FIGS. 11(*a*) and 11(*b*) are side and side sectional views showing another embodiment of a tail plug-combined cartridge tank. The tail plug-combined cartridge tank, designated at 51, shown in FIG. 11 has the almost the same structure as the tail plug-combined cartridge tank shown in FIG. 2, and is made up of the same or similar components. So, the similar structure and components are allotted with the same reference numerals as in FIG. 2, without detailed description.

In the tail plug-combined cartridge tank 51 shown in FIG. 11, an advancing element 52 provides the function of a tail plug, or the advancing element 52 constitutes one-piece structure also serving as a tail plug. Therefore, in the cartridge type writing instrument, the whole configuration including the tail plug can be replaced when the cartridge tank is replaced.

In the tail plug-combined cartridge tanks shown in FIGS. 10 and 11, though slits 12 for easy press fitting and removal with respect to barrel 2 are provided, provision of slits 12 is not essential in the present invention. In the writing instrument of each embodiment, seal ball 19 is used as a sealing element, the invention should not be limited thereto. Still, it is preferred that the surface of the sealing element in contact with the inner wall of the socket is of a curved surface. In this way, use of a curved surface enhances the sealing performance at the socket and allows easy displacement.

Figure 12:
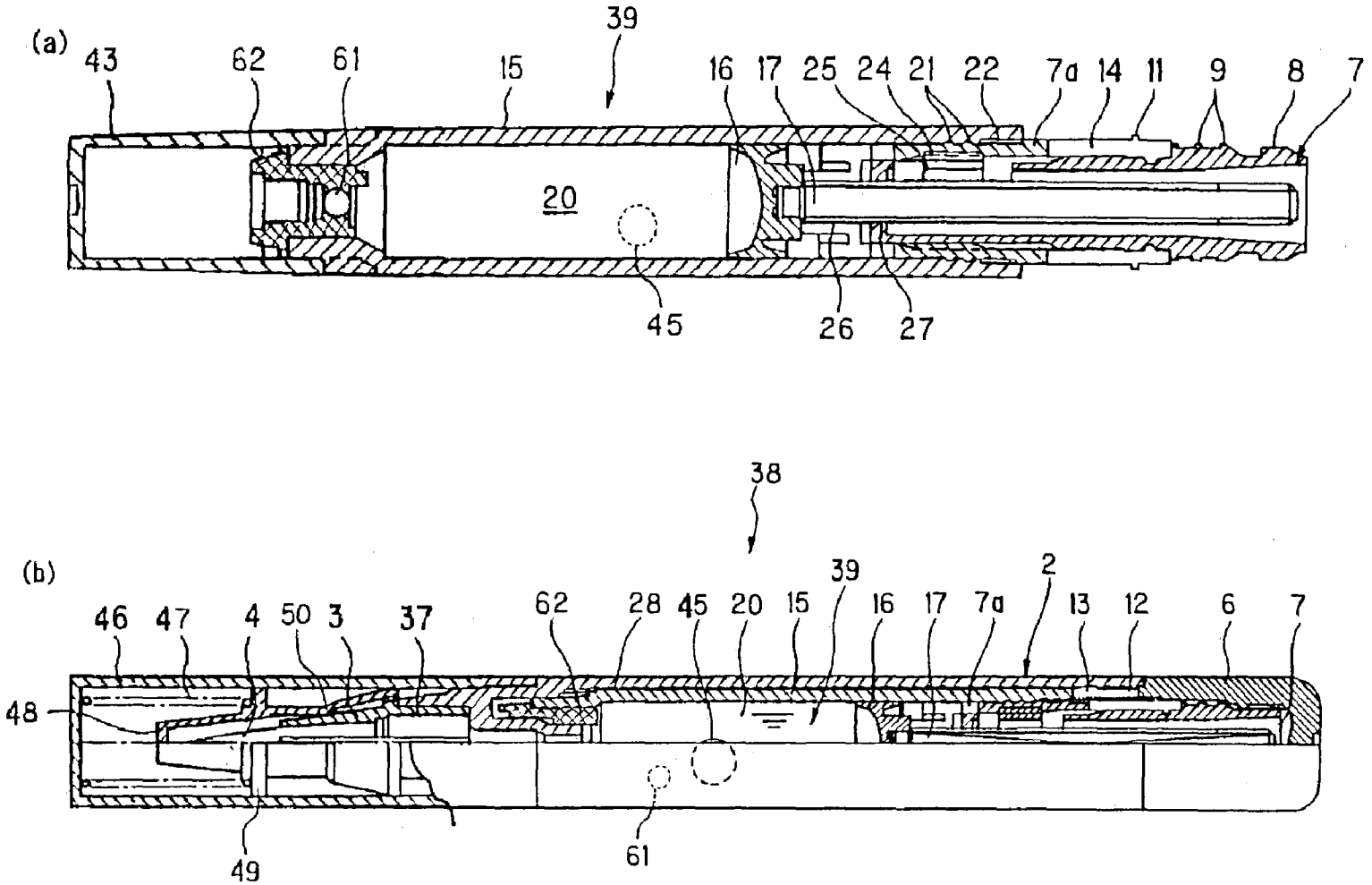
FIGS. 12(*a*) and 12(*b*) are side and side sectional views showing a partly modified variational embodiment of a tail plug-combined cartridge tank, having a preferred cap.

FIGS. 12(*a*) and 12(*b*) are side sectional views showing an embodiment when a cap is provided for the applying portion of the applicator of the present invention. A cartridge tank 39 and a cartridge type applicator 38 shown in FIGS. 12(*a*) and 12(*b*) has almost the same configurations as the cartridge tank and applicator shown in FIGS. 1 and 3, and are made up of the same or similar components. So, the similar structures and components are allotted with the same reference numerals as in FIGS. 1 and 3, without detailed description.

In applying instrument 38 shown in FIGS. 12(*a*) and 12(*b*), cartridge tank 39 includes a piston mechanism comprised of a tank body, an advancing element 7, a sealing plug 16 and a threaded rod, as the cartridge tank shown in FIGS. 2 and 3. A removable temporary cap 43 has been fitted at the front end of tank 39 and is removed when the tank is used. A socket 62 formed of thermoplastic resin is arranged in the front end part. A removable seal ball 61 is placed in socket 62. In this embodiment, since an agitator ball 45 is provided beforehand in tank 39, it is not necessary for seal ball 61 to have an agitating function. Therefore, the seal ball is adapted in size suitable for the socket 62 which is designed so as to have a high degree of formability.

Usually, cartridge type applicator 38 includes a removable cap 46 covering both the front barrel 3 and writing part 4. In this case, an elastic element or coil spring 47 which is fixed at its one end to the ceiling of cap 46 is provided. The other end of coil spring 47 is attached to an inner cap element 48 which is formed with a guide flange 49 to allow the cap piece 48 to smoothly move along the inner wall surface of cap 46. The side wall of guide flange 49 also serves as a receiver for coil spring 47. When cap 46 is fitted to body 2, coil spring 47 is compressed and inner cap element 48 is pressed against writing part 4. Therefore, the mouth, designated at 50, of inner cap element 48 and outer peripheral wall face of front barrel 3 abut each other under a predetermined pressure.

With the thus constructed cartridge type applicator 38, when cap 46 is capped on writing part 4, mouth 50 of inner cap element 48 abuts the outer peripheral wall face of front barrel 3 first, so that inner cap element 48 moves. Then, coil spring 47 is compressed by the abutment and movement. As cap 46 is fully fitted, mouth 50 and the outer peripheral wall face of front barrel 3 uniformly and appropriately abut each other by virtue of the repulsive force of coil spring 47, thus making it possible to establish snug capping, neither too weak nor too strong.

Accordingly, excess pressure between mouth 50 and the outer peripheral wall face, from repeated actions of fitting and removal of cap 46, never occurs, or conversely, sealing performance never degrades due to loose abutment. Since the repulsive force of coil spring 47 is substantially uniform and weak, so is the pressure arising in the narrow inner space between the inner cap element and the applying portion. Therefore, it is possible to maintain a good pressure state in combination with maintenance of the pressure state of the storage tank.

In reference to the above, when, upon start of use, cap 46 is pulled out from front barrel 3, inner cap element 48 is pushed by coil spring 47 and comes out near to the end face of cap 46. As front barrel 3 is further pulled, inner cap element 48 further moves, stretching coil spring 47, as a result of the condition of pressing fit between mouth 50 and the outer peripheral wall face. When coil spring 47 is extended to a certain degree, mouth 50 and the outer peripheral wall face separate due to the repulsive force. Thereby, inner cap element 48 returns to the neutral position within cap 46 where coil spring 47 receives no load.

Figure 13:
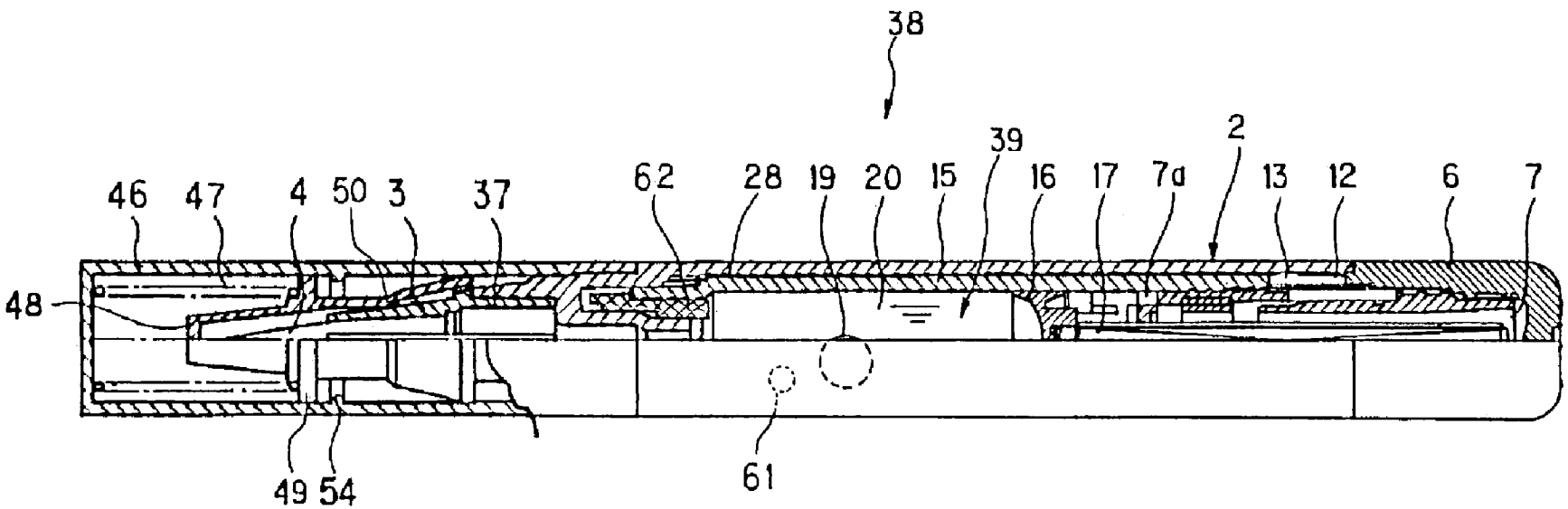
FIG. 13 is a sectional side view showing another cap configuration derived from that shown in FIG. 12.
Figure 14:
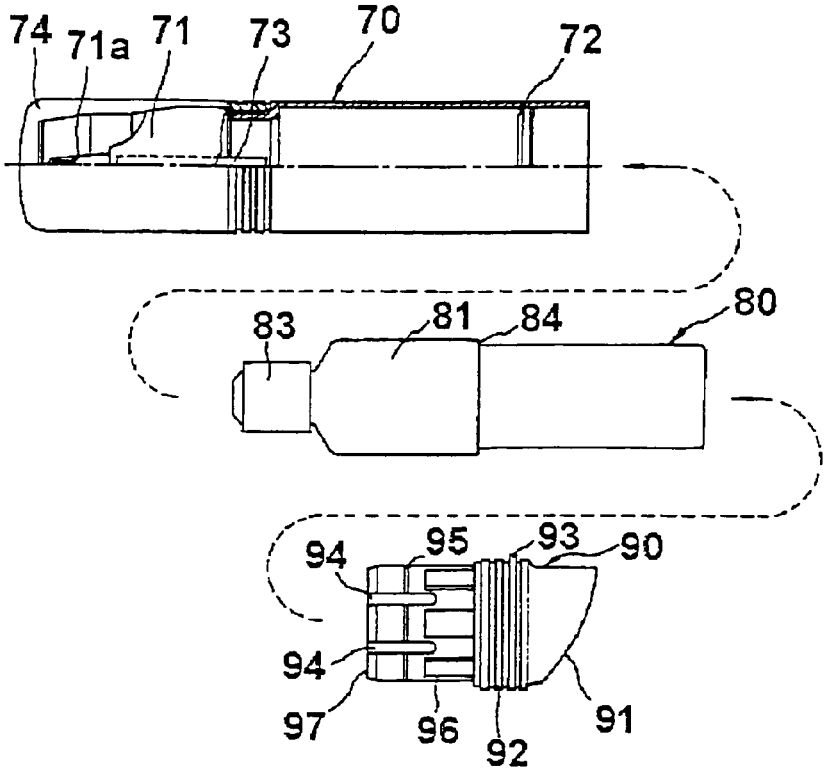
FIG. 14 Prior Art
FIG. 14 is a partially sectional side view showing the disassembled essential parts of a conventional cartridge type applicator; and, FIG. 15 is a partially sectional side view showing a conventional cartridge type applicator.
Figure 15:
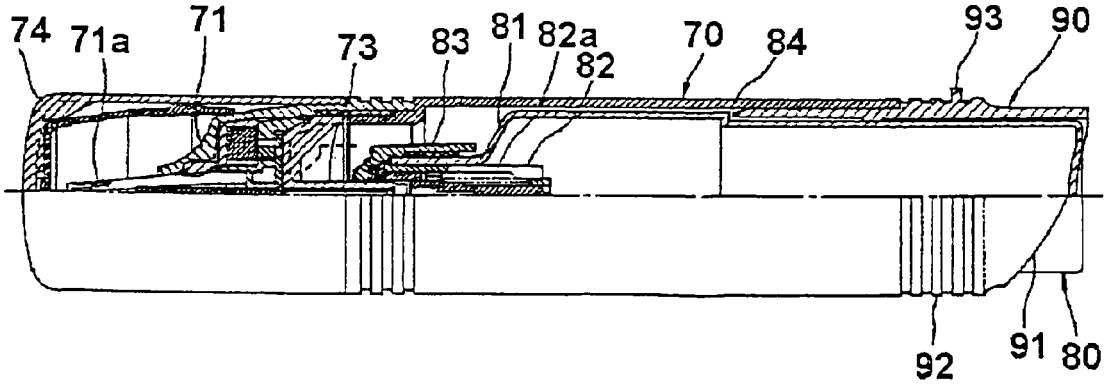
FIG. 15 Prior Art

In this case, a stopper projection 54 is formed on the inner wall surface of cap 46 as shown in FIG. 13, so as to limit excess movement of inner cap element 48 when mouth 50 separates from the outer peripheral wall face, whereby it is possible to prevent useless extension of coil spring 47 and hence extend the life of coil spring 47.

In the present invention, the cartridge type applicator includes: an advancing mechanism or piston mechanism which is comprised of a sealing plug disposed inside a cylindrical cartridge tank for constituting the rear end wall of the cylindrical cartridge tank and a rod member attached to the sealing plug and actuating the sealing plug to move in the axial direction of the tank; and an actuator (or actuating member) which moves or advances the rod member in the axial direction as it is turned. As the actuator is turned, the sealing plug moves in the axial direction by means of the rod member, so that the volume of the space in the tank can be reduced. As a result, it is possible to provide a cartridge type applicator which can prevent the application liquid from flowing back from the applying portion into the cartridge and which can be adapted for use with a high viscosity application liquid.

What is claimed is:

1. A cartridge type applicator comprising:

a hollow barrel body;

an applying portion provided so that part thereof is projected from the front end of the barrel body;

a cartridge tank which can be removably inserted from the rear end of the barrel body and can store the application liquid and supply the application liquid to the applying portion;

a sealing plug constituting the rear end wall of the tank;

a rod member attached to the sealing plug for causing the sealing plug to move in the axial direction of the tank; and an actuator for causing the rod member and sealing plug to move in the axial direction by rotation thereof;

wherein the tank has in the inner wall, at the front end part thereof, a socket for a removable sealing element which seals the front end opening, and the inner wall of the socket is formed in a turnup wall configuration in which a clearance is formed around the inner wall.

2. The cartridge type applicator according to claim 1, wherein a tail plug, which covers part of the actuator and is unable to rotate relative to the actuator, is rotatably and removably attached at the rear end part of the barrel body, the actuator is turned by rotating a tail plug in the circumferential direction, whereby the rod member and sealing plug are caused to move in the axial direction.

3. The cartridge type applicator according to claim 2, wherein an engaging portion for engagement with the outer wall of the actuator is formed along the axial direction in the inner wall of the tail plug while an engaging portion for engagement with the inner wall of the tail plug is formed along the axial direction in part of the outer wall of the actuator, so that the tail plug and actuator are disabled to rotate relative to the other by mutual engagement between the tail plug and the actuator.

4. The cartridge type applicator according to claim 2, wherein an engaging portion is formed circumferentially on one of the outer wall and the inner wall surface of the tail plug while an engaging portion is formed circumferentially on the other one of the inner wall and the outer wall surface of the barrel body, and one of the tail plug and the barrel body is formed with a slit, extending in the axial direction and, allowing for easy press fit and easy removal, whereby the tail plug is press fitted into the rear end part of the barrel body so that the engagement portions engage with each other in a disengageable manner.

5. The cartridge type applicator according to claim 2, wherein an engaging portion is formed in the cartridge tank along the axial direction thereof while an engaging portion is formed in the inner wall of the barrel body in the axial direction thereof, so that when the tank is fitted, the engaging portions of the tank and the barrel body engage each other and the barrel body interior and the tank are disabled to rotate relative to the other.

6. The cartridge type applicator according to claim 1, wherein the actuator is configured so as to provide the function of a tail plug for the barrel body.

7. The cartridge type applicator according to claim 6, wherein an engaging portion is formed circumferentially on one of the outer wall and the inner wall surface of the tail plug while an engaging portion is formed circumferentially on the other one of the inner wall and the outer wall surface of the barrel body, and one of the tail plug and the barrel body is formed with a slit, extending in the axial direction and, allowing for easy press fit and easy removal, whereby the tail plug is press fitted into the rear end part of the barrel body so that the engagement portions engage with each other in a disengageable manner.

8. The cartridge type applicator according to claim 6, wherein an engaging portion is formed in the cartridge tank along the axial direction thereof while an engaging portion is formed in the inner wall of the barrel body in the axial direction thereof, so that when the tank is fitted, the engaging portions of the tank and the barrel body engage each other and the barrel body interior and the tank are disabled to rotate relative to the other.

9. The cartridge type applicator according to claim 6, wherein an engaging portion is formed circumferentially on one of the outer wall and the inner wall surface of the tail plug while an engaging portion is formed circumferentially on the other one of the inner wall and the outer wall surface of the barrel body, and one of the tail plug and the barrel body is formed with a slit, extending in the axial direction and, allowing for easy press fit and easy removal, whereby the tail plug is press fitted over the rear end part of the barrel body so that the engagement portions engage with each other in a disengageable manner.

10. The cartridge type applicator according to claim 1, wherein the sealing element provides the function of an agitator of the application liquid in the tank.

11. The cartridge type applicator according to claim 1, wherein the tank has in the inner wall at the front end part thereof a socket for a removable sealing element which seals the front end opening, and the socket is constituted by an element formed of a thermoplastic resin molding.

12. The cartridge type applicator according to claim 11, wherein the sealing element provides the function of an agitator of the application liquid in the tank.

13. The cartridge type applicator according to claim 1, wherein an engaging portion is formed in the cartridge tank along the axial direction thereof while an engaging portion is formed in the inner wall of the barrel body in the axial direction thereof, so that when the tank is fitted, the engaging portions of the tank and the barrel body engage each other and the barrel body interior and the tank are disabled to rotate relative to the other.

14. The cartridge type applicator according to claim 1, further comprising:

a removable cap for covering the applying portion; and an inner cap element disposed in the cap and pressed toward the applying portion by means of an elastic element when the cap is fitted, wherein the inner cap element has a mouth which can come into sealing contact with the outer peripheral wall face of the applying portion, with a predetermined pressure.

15. The cartridge type applicator according to claim 14, wherein the inner cap element is suspended by the elastic element so that it can move in the axial direction within the cap.

16. The cartridge type applicator according to claim 15, wherein the stopper projection is formed in the inner wall of the cap so as to limit excess movement of the inner cap when the cap is removed.

* * * * *